US005650808A

United States Patent [19]

Vincent et al.

[11] Patent Number: 5,650,808

[45] Date of Patent: Jul. 22, 1997

[54] COLOR INK JET PEN HAVING NOZZLE GROUP SPACING TO PREVENT COLOR BLEED

[75] Inventors: Kent Douglas Vincent, Cupertino; John Phillip Ertel, Portola Valley, both of Calif.

[73] Assignee: Hewlett-Packard Company, Palo Alto, Calif.

[21] Appl. No.: 502,104

[22] Filed: Jul. 13, 1995

Related U.S. Application Data

[63] Continuation of Ser. No. 110,270, Aug. 23, 1993, abandoned, which is a continuation of Ser. No. 946,246, Sep. 17, 1992, abandoned, which is a continuation of Ser. No. 600,640, Oct. 19, 1990, abandoned.

[51] Int. Cl.[6] ..... B41J 2/21

[52] U.S. Cl. ..... 347/43; 347/47

[58] Field of Search ..... 347/40, 41, 43, 347/47

[56] References Cited

U.S. PATENT DOCUMENTS

| | | | |
|---|---|---|---|
| 4,320,406 | 3/1982 | Heinzl | 347/43 |
| 4,528,576 | 7/1985 | Koumaura et al. | 347/43 |
| 4,540,996 | 9/1985 | Saito | 347/43 |
| 4,680,596 | 7/1987 | Logan | 347/43 X |
| 4,682,186 | 7/1987 | Sasaki et al. | 347/43 X |
| 4,709,246 | 11/1987 | Piatt et al. | 347/49 |
| 4,812,859 | 3/1989 | Chan | 347/43 X |
| 4,855,752 | 8/1989 | Bergstedt | 347/43 X |
| 4,914,562 | 4/1990 | Abe et al. | 347/63 |
| 4,914,736 | 4/1990 | Matsuda | 347/43 X |
| 4,940,998 | 7/1990 | Asakawa | 347/43 X |
| 5,012,257 | 4/1991 | Lowe | 347/43 |
| 5,079,571 | 1/1992 | Eriksen | 347/43 |

FOREIGN PATENT DOCUMENTS

| | | | |
|---|---|---|---|
| 0294793 | 12/1988 | European Pat. Off. | B41J 3/04 |
| 8906890 U | 8/1990 | Germany | B41J 2/21 |
| 359089160 | 5/1984 | Japan | B41J 3/00 |
| 401208143 | 8/1989 | Japan | B41J 3/04 |

OTHER PUBLICATIONS

Patent Abstracts of Japan, vol. 14, No. 140 (M-950) 167 Mar. 1990, Canon Inc., Suzuki.

Patent Abstracts of Japan, vol. 11, No. 123 (M-581) 17 Apr. 1987 & JP-A-61 263 760 (Hitachi Koki Co. Ltd) 21 Nov. 1986.

Patent Abstract of Japan, vol. 12, No. 171 (M-700) 21 May 1988 & JP-A-62 288 043 (Seiko Epson Corp) 14 Dec. 1987.

European Search Report, Jul. 7, 1994, re Application 94201104.0.

*Primary Examiner*—Joseph W. Hartary

[57] ABSTRACT

A color ink-jet pen for printing different colors of ink while simultaneously minimizing or eliminating color bleed. The pen includes a printhead having a nozzle plate for ejecting ink from the printhead onto the print medium. The nozzle plate includes a plurality of groups of nozzles, with each nozzle group dispensing a different color of ink and with adjacent nozzles in each group being separated by an index length. Adjacent groups of nozzles are always separated from each other by a group spacing distance greater than the index length. The group spacing distance is equal to an integer multiple of the index length, yet less than the swath width for each group. The pen is used in an ink-jet printer wherein the swath advance distance by which the paper is advanced between each swath is equal to the number of nozzles within a color group times the index distance. The printer provides a data offset for successive swaths which is the number of index lengths establishing the swath advance distance plus the group spacing distance.

11 Claims, 3 Drawing Sheets

COLOR INK JET PEN HAVING NOZZLE GROUP SPACING TO PREVENT COLOR BLEED

RELATED APPLICATIONS

This application is a continuation of application Ser. No. 08/110,270 filed in Aug. 23, 1993, abandoned which is a continuation of application Ser. No. 07/946,246, filed Sep. 17, 1992 abandoned, which in turn is a continuation of application Ser. No. 07/600,640 filed Oct. 19, 1990, now abandoned.

TECHNICAL FIELD

The present invention relates generally to computer hard-copy printers and more particularly to ink-jet printers. The predominant current usage of the improved thermal ink-jet printer assembly of the present invention is as a means of obtaining high definition color printouts of computer generated text and graphics.

BACKGROUND ART

With the advent of computers came the need for devices which could produce the results of computer generated work product in a printed form. Early devices used for this purpose were simple modifications of the then current electric typewriter technology. But these devices could not produce picture graphics, nor could they produce multicolored images, nor could they print as rapidly as was desired.

Numerous advances have been made in the field. Notable among these has been the development of the impact dot matrix printer. While that type of printer is still widely used, it is neither as fast nor as durable as is required in many applications. Nor can it easily produce high definition color printouts. The development of the thermal ink-jet printer has solved many of these problems. U.S. Pat. No. 4,728,963 issued to S. O. Rasmussen et al., and assigned to the same assignee as is this application, teaches an example of this type of printer technology.

Thermal ink-jet printers operate by employing a plurality of resistor elements to expel droplets of ink through an associated plurality of nozzles. In particular, each resistor element, which is typically a pad of resistive material about 50 μm by 50 μm in size, is located in a chamber filled with ink supplied from an ink reservoir. A nozzle plate, comprising a plurality of nozzles, or openings, with each nozzle associated with a resistor element, defines a part of the chamber. Upon the energizing of a particular resistor element, a droplet of ink is expelled by droplet vaporization through the nozzle toward the print medium, whether paper, fabric, or the like. The firing of ink droplets is typically under the control of a microprocessor, the signals of which are conveyed by electrical traces to the resistor elements.

The pen containing the nozzles is moved repeatedly across the width of the medium to be printed upon. At each of a designated number of increments of this movement across the medium, each of the nozzles is caused either to eject ink or to refrain from ejecting ink according to the program output of the controlling microprocessor. Each completed movement across the medium can print a swath approximately as wide as the number of nozzles arranged in a column on the pen multiplied times the distance between nozzle centers. After each such completed movement or swath, the medium is moved forward the width of the swath, and the pen begins the next swath. By proper selection and timing of the signals to the nozzles, the desired print is obtained on the medium.

In order to obtain multicolored printing, the column of nozzles in the pen can be allocated to the distribution of different colored inks. For instance, a pen with a column of nozzles 48 nozzles in length may be constructed such that the first twelve nozzles can be supplied with cyan ink, the next twelve nozzles can be supplied with magenta ink, the next twelve with yellow ink, and the last twelve with black ink. Using this arrangement, each complete movement or swath of the pen across the medium could print four color bands, each band being twelve nozzle spacings or index positions wide. The medium would then be advanced twelve index positions so that the next swath would have the magenta ink nozzles moving over the same medium positions as were the cyan ink nozzles on the previous swath. By continuing to advance the medium by twelve index positions before each swath of the pen, each of the print positions on the medium could, if directed by the microprocessor, be printed by each of the ink colors. Using this arrangement, any given individual position on the print medium is addressed four times on four consecutive swaths. But the print medium will have advanced twelve index positions between each swath. Therefore, the information from the computer concerning this print position has to be temporarily stored and used on the four consecutive swaths, each of which is separated by twelve index positions. This is referred to as a data index of twelve lines. Using this arrangement, it is possible to produce reasonably high quality multicolored printed images of both alphanumeric characters and graphics at a reasonably high rate of speed.

But thermal ink-jet printer technology is itself not without problems, and considerable need has existed for a means of solving some of these problems. The most obvious problem associated with thermal ink-jet printers has been the tendency of the print produced to be of a less than desirable definition or quality. Highest character definition could be achieved if ink were deposited on the media only where intended if the ink would stay where it is deposited without migrating. Unfortunately, because of phenomena such as that of the wet ink being drawn into the surrounding dry media by capillary action, the edges of the printed characters tend to become less defined. Also, when inks of differing colors are printed adjacent to each other, the different colored inks tend to bleed into each other. Further, the wet ink on print media that have a low absorption rate (i.e., transparency film) tends to clump together in small puddles due to surface tension, thus creating a phenomenon called ink coalescence. Another problem encountered in ink-jet printing is paper cockle. The ink used in thermal ink-jet printing is of a liquid base. When the liquid ink is deposited on wood-based papers, it absorbs into the cellulose fibers and causes the fibers to swell. As the cellulose fibers swell, they generate localized expansion, which, in turn, causes the paper to warp uncontrollably in these regions. This phenomenon is called paper cockle. This can cause a degradation of print quality due to uncontrolled pen-to-paper spacing, and can also cause the printed output to have a low quality appearance due to the wrinkled paper.

Hardware solutions to these problems have been attempted. Heating elements have been used to dry the ink rapidly after it is printed. But this has helped only to reduce smearing that occurs after printing. Prior art heating elements have not been effective to reduce the problems of ink migration that occur during printing and in the first few fractions of a second after printing.

Other types of printer technology have been developed to produce high definition print at high speed, but these are much more expensive to construct and to operate, and thus they are priced out of the range of most applications in which thermal ink-jet printers may be utilized.

To the inventors' knowledge, no prior art solution to the problem of lack of definition in the product of thermal ink-jet printers has been, either singly or in combination with other attempted solutions, successful in bringing the overall print definition of these printers within optimal limits.

DISCLOSURE OF INVENTION

This invention relates to an ink-jet printer having conventional print medium, carriage, and handling mechanisms but also having several unique features which serve to enhance the definition of the print produced. These features each individually contribute to the improved definition and also each contribute to the operation and effectiveness of the other unique features of the inventive printer such that they function together as a system to optimize print definition.

In accordance with a preferred ink jet pen embodiment of the invention, there is provided herein an ink jet pen for printing different colors of ink while simultaneously minimizing or eliminating color bleed. This pen includes a plurality of nozzle groups, with each nozzle group dispensing a different color of ink and with adjacent nozzles in each group being separated by a certain distance. The pen is further characterized in that adjacent groups of nozzles are always separated from each other by a distance greater than the certain distance separating adjacent nozzles within each group.

Briefly, the presently preferred embodiment of the present invention is a thermal ink-jet printer having a metal platen upon which paper is positioned for printing and a paper feed mechanism for drawing the paper across the platen. The platen, which may comprise a flat or curved surface, contains a platen heating assembly which heats the paper prior to, during, and after printing. The media is heated in an area covering one full swath immediately prior to the printing area (a preheating area) to give the medium sufficient time to come up to temperature. It is heated in the printing area and also in an area one full swath after the printing area to insure that the ink is completely dried and/or fixed. The addition of the preheating area insures that the medium will be within temperature specifications at the time of printing. Temperature specifications will vary between 50° C. and 180° C., depending upon the type of medium and the ink formulation used and the print density required. Some minimal experimentation is required to adjust optimum temperature within the specified range for each new combination of medium, ink, and print density.

A partial vacuum is created in the interior of the printer by any conventional vacuum-producing means, such as a vacuum fan, a vacuum pump, a venturi pump, and the like. A plurality of holes in the platen heating assembly serve to expose the paper to this partial vacuum and thus to draw the paper into contact with the heating assembly for efficient conduction of heat into the paper. A pen containing a plurality of ink-jet nozzles is moved transversely across the paper to position the nozzles for firing droplets of ink as directed by a microprocessor controller.

The pen contains a plurality of nozzles for each color ink utilized in the printer. It has been discovered by the inventors that the problem of coalescence of different colored inks is due in great part to the fact that prior art methods have caused different colored inks to be printed simultaneously in adjacent bands, and thus the different colored inks were potentially on the medium and adjacent to each other while both were still wet, and thus the colors tended to bleed together. Therefore, the nozzles of the inventive printer are arranged in a column such that adjacent nozzles for the same color are placed at a uniform spacing of one index length center to center, but that adjacent nozzles for different colored inks are placed at a greater distance (a multiple of the index length). This provides a physical gap between simultaneously printed different colors and allows a drying time between any possible application of different colors to two adjacent print positions. Although this arrangement is much more difficult to conceptualize than prior art nozzle arrangements because a given position on the medium will not simply be addressed by the similarly positioned nozzles of each of the groups of nozzles for different colored inks, it does not increase the complexity of date flow to the pen since it merely requires a simple alteration of an already existing data index number.

An advantage of the present invention is that print definition is improved as compared to prior art ink-jet printers.

Another advantage of the present invention is that ink migration is halted by rapid drying of the ink on the medium.

Another advantage of the present invention is that inks of different colors are never printed simultaneously adjacent to each other and thus are never in contact with each other when both are wet, and thus the different colored inks cannot bleed together.

Another advantage of the present invention is that the ink does not coalesce on print media that have a low absorption rate.

Another advantage of the present invention is that the print quality on plain paper is improved, because the paper flatness is better controlled, due to minimization of paper cockle.

Another advantage of the present invention is that the plain paper output has improved quality due to the absence of paper cockle.

Another advantage of the present invention is that the printed medium can be handled immediately after printing because the ink is already dry.

Yet another advantage of the present invention is that no special coating or preparation of the print medium is required.

A further advantage of the present invention is that the inventive system will operate over a wide temperature range, thus making its use appropriate for a wide variety of print media.

Another advantage of the present invention is that it maintains the cost to manufacture associated with thermal ink-jet printers.

These and other advantages of the present invention will become clear to those skilled in the art in view of the description of the best presently known modes of carrying out the invention and the industrial applicability of the preferred embodiments as described herein and as illustrated in the several figures of the drawing.

BEST MODES FOR CARRYING OUT THE INVENTION

The present invention is directed to ink-jet printers, and is independent of the means of ejecting a droplet of ink. Any ink-jet printer, such as piezoelectric, thermal, or others, is within the scope of the invention. The embodiments described herein are with reference to thermal ink-jet printers; however, the invention is not limited thereto.

The best presently known mode for carrying out the invention is a thermal ink-jet printer constructed such that the paper or other media to be printed is heated, and such that the color bands to be printed in each swath of the printer head are physically separated. The predominant expected usage of the inventive printer is as a means of producing high quality color computer output hardcopy.

Figure 1:
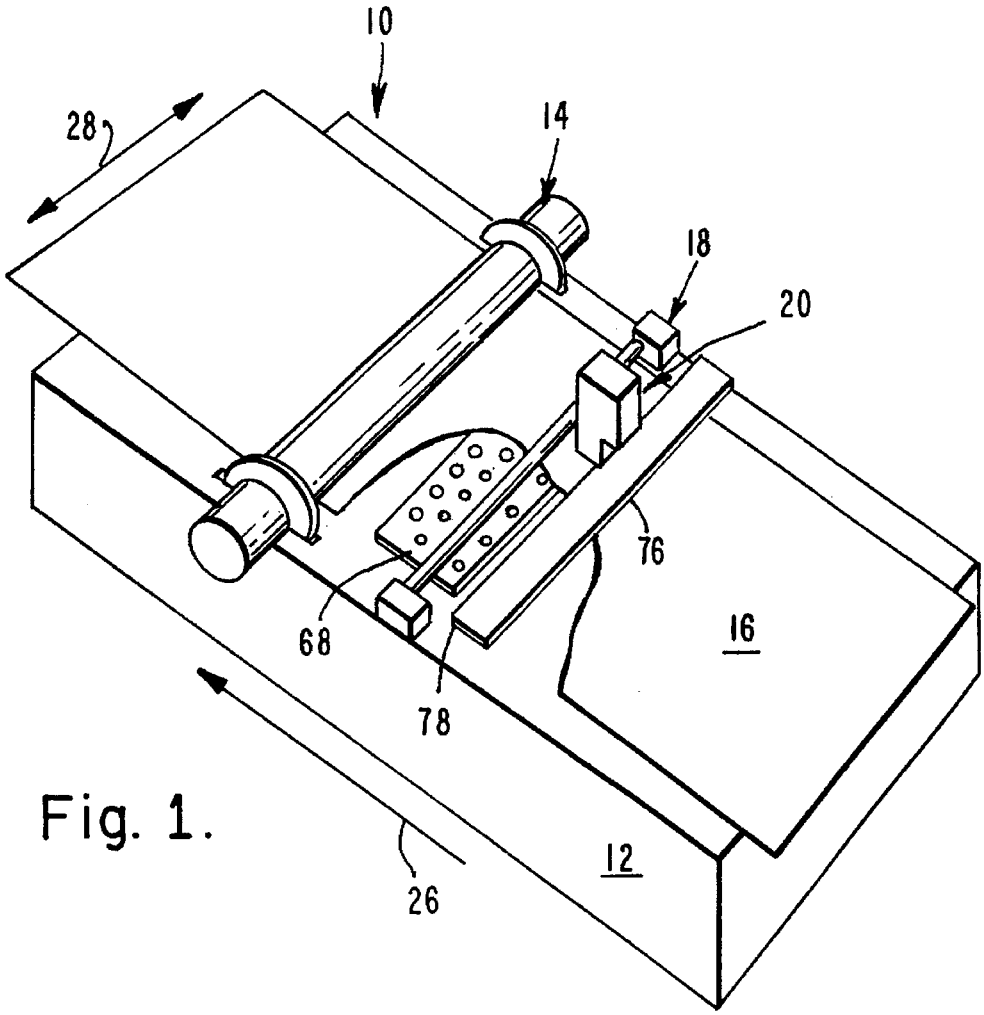
FIG. 1 is a perspective view of an improved thermal ink-jet printer according to the present invention.

The thermal ink-jet printer of the presently preferred embodiment of the present invention is illustrated in a perspective view in FIG. 1 and is designated therein by the general reference character 10. In many of its substantial components, the printer 10 does not differ significantly from conventional thermal ink-jet printers. The conventional elements of printer 10 include a printer body 12, a paper feed mechanism 14 for advancing the paper 16, and a pen traversing mechanism 18. The paper feed mechanism may be of the commonly used mechanisms, such as tractor, friction, or other drive means.

Figure 2:
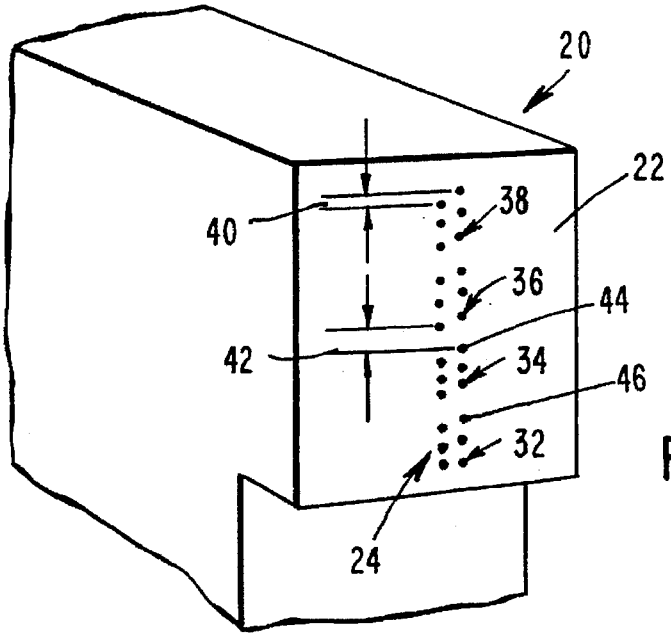
FIG. 2 is a perspective view of the pen assembly of the present invention.

The inventive printer 10 also includes a pen 20. The detail of the pen assembly 20 is depicted in FIG. 2. The pen 20 has attached thereon a nozzle plate 22 having, in the best presently known embodiment of the invention, twenty four nozzles 24 which nozzles 24 are apertures in the nozzle plate 22 of about 50 μm in diameter. The size of the nozzles 24 is selected to provide an ink drop volume of approximately 115 picoliters plus or minus 10 picoliters, as this volume has been found by the inventors to be most effective, given the other aspects of the inventive printer 10, as described herein.

The nozzles 24 are arranged in a staggered column, as depicted in FIG. 2, in order to allow closer vertical spacing of the nozzles 24. This arrangement of nozzles is not unique to the present invention, nor is the present invention dependent upon this particular arrangement. Since data controlling ink ejection from the nozzles is manipulated to time ink ejection to simulate a single row column of nozzles 24 an understanding of the present invention might be aided by thinking of the nozzles 24 as being arranged in a single row column, as will be discussed hereinafter. To illustrate the relationship of FIG. 1 to FIG. 2, the column of nozzles 24 is situated parallel to the direction of travel 26 of the paper 16 and perpendicular to the plane of movement 28 of the pen 20 itself. The arrangement of nozzles 24 on the pen nozzle plate 22 can be seen in FIG. 2. The nozzles 24 are grouped into four sets of six each. Each set is supplied by a different portion of an ink reservoir (not shown). In the commercial embodiment, as many as twelve or more nozzles per color may be employed.

The preferred embodiment of the present invention has a first group of nozzles for cyan ink 32, a second group of nozzles for magenta ink 34, a third group of nozzles for yellow ink 36, and a fourth group of nozzles for black ink 38. The distance span 40 between centers of any two adjacent nozzles 24 of the same group is approximately 0.085 mm to reflect a conventional resolution of 300 dots per inch (DPI). Other resolutions would cause a corresponding change in the distance space. This center to center distance span 40 is also referred to as one index length. A group separation span 42 is the distance between adjacent nozzles 24 of different color groups 32, 34, 36 and 38 and is approximately 0.170 mm (for 300 DPI), or approximately two index lengths. Each swath of the pen 20 across the paper 16 moves the nozzles 24 of each of the color groups 32, 34, 36 and 38 across a band of paper six index lengths wide. At each location across the paper 16, each of the nozzles 24 may be directed by the controlling microprocessor (not shown) to fire a droplet of ink onto the paper 16. The paper 16 is then advanced six index lengths before the pen 20 makes its next swath.

Data offset is the number of index lengths by which any nozzle 24 follows the corresponding nozzle 24 in the preceding color band. The data offset will normally be the number of nozzles of a given color band plus the nozzle equivalent of the group separation span. An example of data offset in the preferred embodiment of the present invention is the number of index positions the paper 16 must be advanced before a first magenta ink nozzle 44 is over the same position on the paper 16 as was a first yellow ink nozzle 46 during a last previous pass of the pen 20. The preferred embodiment of the invention described herein uses a data offset of six index lines. Data offset is used in prior art printer designs. However, heretofore data offset in such applications has been equal to an actual number of nozzles 24 used per color of ink. As can be appreciated from the description herein, the adjustment to the data offset number is necessary to accommodate the unique placement of nozzles 24 described herein, and the associated method of printing.

Figure 3:
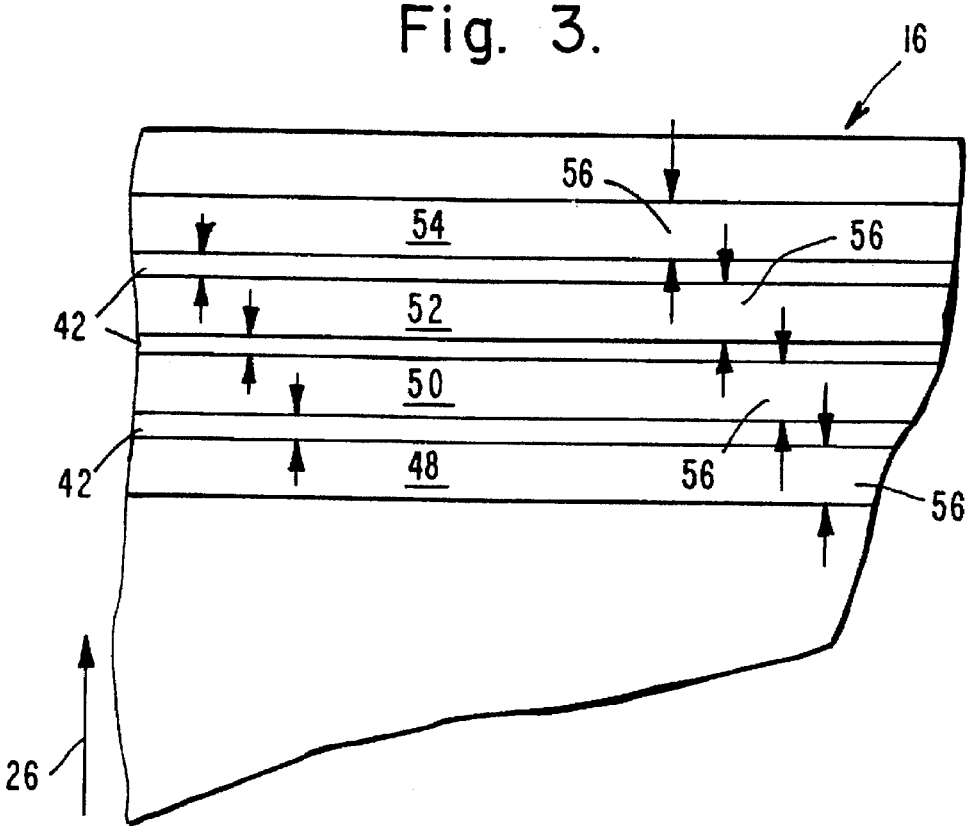
FIG. 3 is a diagrammatic example of a possible pattern produced by a single pass of a print pen.

To further represent the pattern of printing which is an aspect of the present invention, FIG. 3 illustrates in diagrammatic form a portion of the medium 16 as it might appear after a single pass of the pen 20. As can be appreciated by one skilled in the art, the single pass illustrated by FIG. 3 is not one of a first three passes, or a final three passes that would be accomplished to produce an overall image. This is because at the beginning and end of any such complete process it is necessary to make passes using only a portion of the available nozzle groups 32, 34, 36 and 38 in order that all of the medium 16 might be printed with all available colors.

In the example illustrated in FIG. 3, a yellow band 48 has been printed by the first nozzle group 32, a magenta band 50 has been printed by the second nozzle group 34, a cyan band 52 has been printed by the third nozzle group 36, and a black band 54 has been printed by the fourth nozzle group 38. Of course, one skilled in the art will recognize that it would be unlikely that it would be desired to print all possible locations on the medium 16 with all available colors. However, since in order to produce any possible desired image it is necessary to have the capability of doing so, this extreme example best illustrates and explains the present invention.

As is shown in FIG. 3, a group separation span 42 separates the color bands 48, 50, 52 and 54 from each other on the single pass shown in the drawing. This prevents different color inks from bleeding together as they are printed, and allows for a drying time (the time between consecutive passes of the pen 20) to occur before there is any possibility of different color inks being printed on the same or adjacent locations on the medium 16. After the pattern shown in the drawing is accomplished, the medium 16 is advanced by a color band width 56 in the paper travel direction 26 (which span is, in the case of the best presently preferred embodiment of the invention as described herein, six index lengths). It is evident that, following such advance, the second nozzle group 34 will not be directly over the yellow band 48. Instead, only four of the six nozzles 24 of the second nozzle group 34 will be over the yellow band 48, with the remaining two nozzles 24 of the second nozzle group 34 being aligned over the group separation span 42 separating the yellow band 48 from the magenta band 50. After this described advance, the pen 20 is ready to begin another pass. The example illustrated by FIG. 3 further illustrates the need for the modification to the data index number heretofore discussed.

Figure 4:
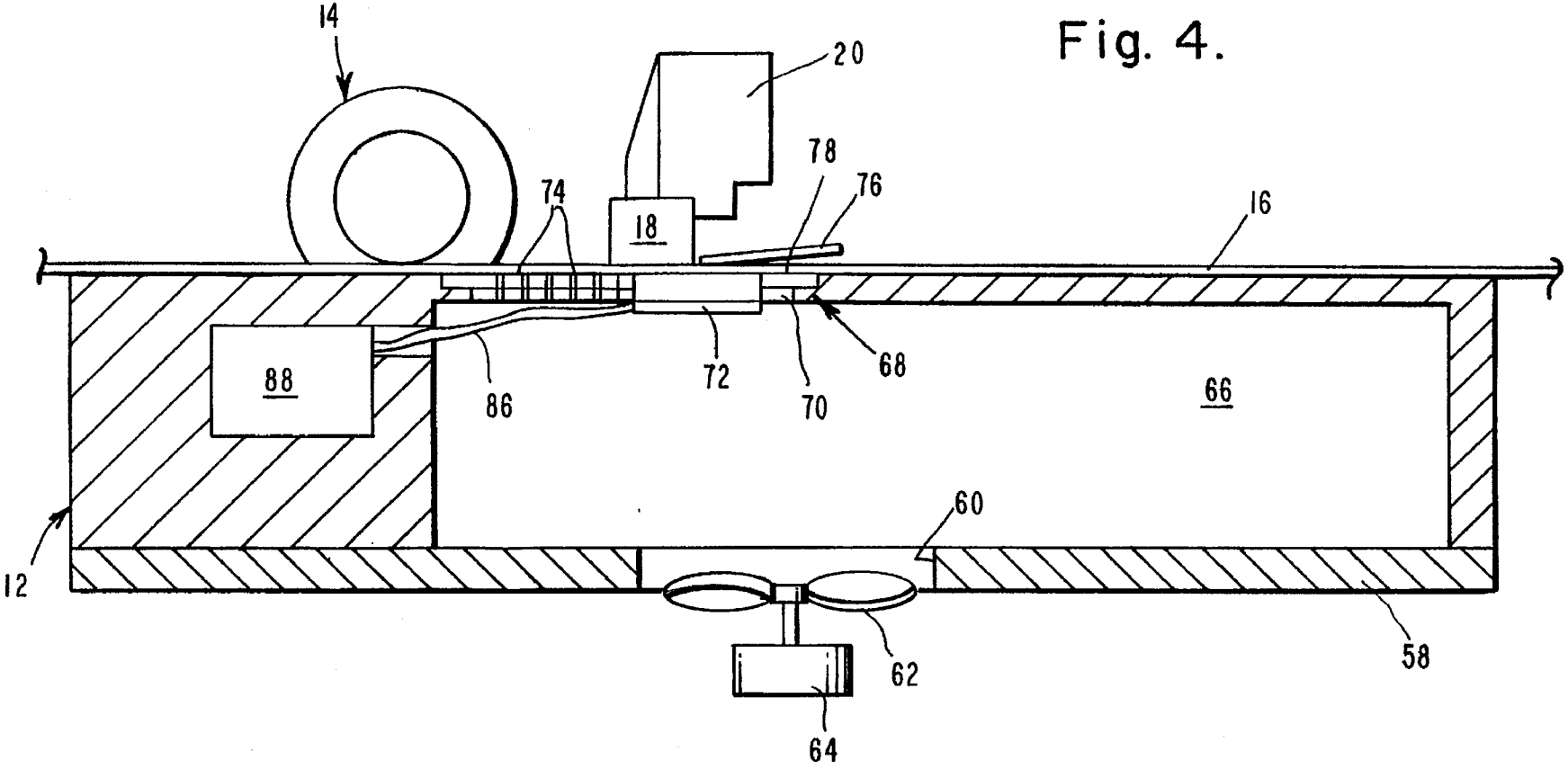
FIG. 4 is a cross sectional side elevational view of the improved thermal ink-jet printer according to the present invention.

Referring now to FIG. 4, wherein is shown a cross-sectional side elevational view of the printer 10, the preferred embodiment of the present invention includes a base plate 58 that, in many respects is not unlike the base plate of conventional printers. However, the base plate 58 of the inventive printer includes an aperture 60 wherein is affixed a vacuum fan 62 and a vacuum fan motor 64. The vacuum fan 62 is positioned so as to draw air out of a hollow center cavity 66 of the printer 10, thus creating a partial vacuum within the center cavity 66. The inventors have found that a vacuum approximately equal to 8 inches of water will work best with the other aspects of the inventive printer 10, as described herein.

Figure 5:
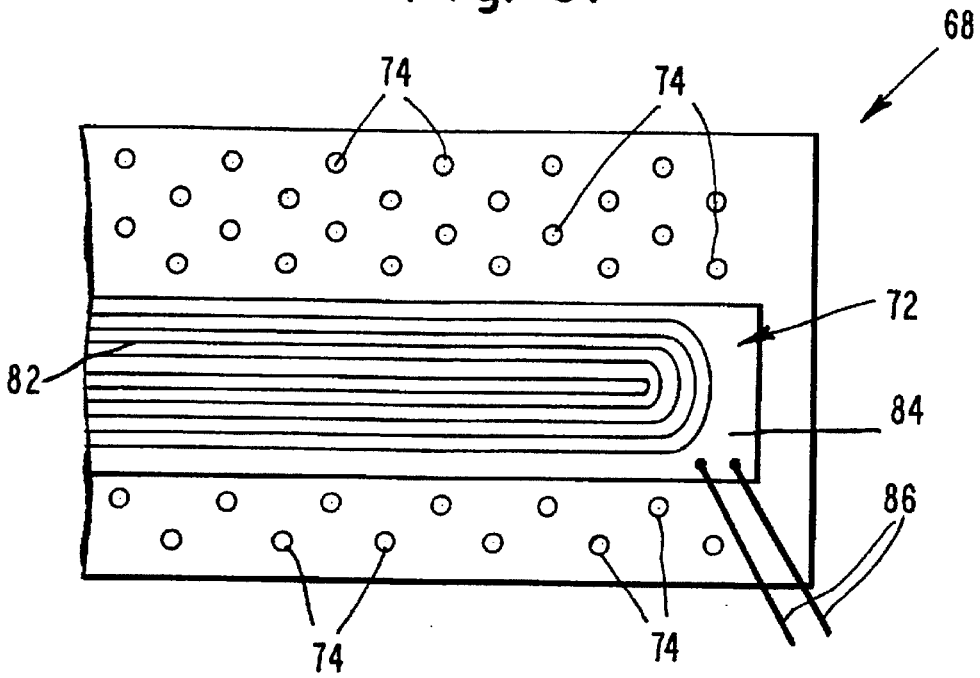
FIG. 5 is a bottom plan view of a platen heater assembly according to the present invention.

The printer 10 of the preferred embodiment of the present invention also includes a platen heater assembly 68 which is depicted in a cut away plan view in FIG. 5 and can also be seen in an elevational cross sectional view in FIG. 4, and in the perspective view of FIG. 1. In one embodiment, the platen heater assembly 68 comprises a low heat capacity heater plate, or platen, 70 to which is affixed a thin foil heater 72. Those skilled in the art will appreciate that other heating means, such as a heater rod, lamp, or similar means may be employed in place of the thin foil heater 72, and the heater plate (or platen) 72 may be flat or curved or partly flat and partly curved.

A plurality of holes 74 is provided in the heater plate 70 positioned such that the paper is pulled onto the heater plate 70 by the vacuum of the hollow center cavity 66. A conventional paper shim 76 is provided to mechanically press the paper 16 against the heater plate 70. This also helps to promote effective heat conduction from the heater plate 70 to the paper 16.

In the preferred embodiment of the invention, the heater plate 70 is made from a low heat capacity metal to give the system fast thermal response without requiring large energy input. With the fast thermal response, the temperature of the platen heater can be modulated to match print density on the same plot, thus, optimizing energy consumption without slowing down the print speed. The low heat capacity platen heater also cools down quickly, thus preventing burns if the user needs to gain access to the print area (such as to clear a paper jam).

The exposed surface 78 of the heater plate 70 is designed for low emissivity so as to minimize heat transfer by radiation to the pen 20. The thin foil heater 72 is of a conventional nichrome etched foil type, comprising foil traces 82, which are created by the conventional process of acid etching a nichrome film that has been bonded to a 5.08 mm thick film substratum. The foil heater 72 is coated on its trace side 84 with a layer approximately 2.54 mm thick of a high temperature thermoplastic adhesive (not shown). This adhesive bonds the thin foil heater 72 to the heater plate 70 and promotes heat conduction from the heater 72 to the heater plate 70. The heater nichrome foil traces 82 are terminated on the film substratum at a pair of heater wires 86 that connect the heater 68 to the heater control circuitry 88 (FIG. 4). The heater control circuitry 88 is a typical heat regulating circuit which allows for adjustment and control of the heat output of the heater 68. Different papers 16 or other print media may need different temperature adjustments for optimal operation of the printer 10. Further, temperature adjustment may be necessary because of differing heat tolerances of alternative media. The inventors have found that the inventive printer 10, using ordinary bond paper and the low viscosity inks with which the printer 10 is designed to best operate, best accomplishes its combined purposes with a platen temperature of about 120° C. plus or minus 20° C.

In the presently preferred embodiment of the invention 10, the heater plate 70 extends under the medium 16 such that heating of any given area of the medium 16 occurs prior to, during, and after printing actually occurs on that given area. This improves performance of the printer 10 by preheating the medium 16 such that solvents in the ink are quickly volatilized upon contact with the medium, and further by continuing to heat the medium after printing has occurred so as to drive off any remaining solvents and to rapidly fix the ink onto the position where it is deposited.

As is shown above, in great part the printer 10 according to the present invention closely resembles prior art conventional printers in many of its components. The substantial differences exist in the inclusion of (a) a means of heating the print media, (b) a means of holding the print media against the heater, and (c) a means of separating simultaneously printed bands of different colors; collectively, the means of this invention provide improved definition of dot shape, reduction of color bleed, reduction of drop coalescence on low absorption media, and reduction of paper cockling and wrinkling. No significant changes of materials are envisioned nor are any special construction techniques required.

Various modifications may be made to the invention without altering its value or scope. For example, while the present invention is described in terms of a printer for producing multicolored images, the principles and unique features of the invention, with the exception of the irregularly spaced nozzles, are equally applicable to mono-color printing devices. Further, while it is expected that the various unique parts of the inventive printer will be utilized together as a system to maximize the beneficial effect of each of them, some benefit could be gained by utilizing the unique features of the present invention individually.

Another possible modification that could be made to the present invention would be to remove the ink reservoir(s) from the pen assembly and to connect them thereto by means of tubing to transfer the inks from the reservoir(s) to the pen.

Another possible modification that could be made would be to change the number of columns of ink-jet nozzles incorporated. The number of columns could be increased as a way of increasing printing speeds by means of reducing the number of individual positions of the pen at which the ink-jets are required to fire. This idea could be extended to the point that there could be sufficient columns of nozzles to extend all the way across the print medium, and thus an entire swath could be printed at one instance of nozzle firing.

The printer could also be constructed using any number of nozzle groups for any number of different colored inks. Also, any number of nozzles per ink color group could be used, and any spacing between color groups that is an even multiple of the index length could be used with appropriate changes to the data index.

Integer nozzle spacing may be provided between nozzles of any given color band to prohibit intra-band bleeding. The paper advance and the data stream would then be appropriately modified to accomplish this, as set forth in the teachings of this invention.

All of the above are only some of the examples of available embodiments of the present invention. Those skilled in the art will readily observe that numerous other modifications and alterations may be made without departing from the spirit and scope of the invention. Accordingly, the above disclosure is not intended as limiting and the appended claims are to be interpreted as encompassing the entire scope of the invention.

INDUSTRIAL APPLICABILITY

Ink-jet printers are likely to find increased usage as the technology is advanced. They can operate at higher speeds than can printers with mechanical print mechanisms. They are more adaptable to extended continuous usage since they have no moving parts in the print head. And because they do not physically impact the print medium, they can be used on delicate or even irregularly shaped media. The predominant current usage of the embodiment of the present invention is in producing computer data printing for applications such as letter correspondence and desk top publishing.

The ink-jet printer of the present invention may be utilized in many applications wherein conventional printers are used. Because it can print faster than prior art printers in the same potential price range with comparable print quality, a single printer of the present invention may be used to replace several prior art printers in multi-user computer network systems.

Since the unique properties of the ink-jet printing system of the present invention are all compatible with a wide variety of print media and since the print media needs no special coating or preparation, it is further expected that the inventive printer will be used in a variety of specialized industrial applications such as producing drafts of drawings for electrical and mechanical engineers.

Since the improved ink-jet printers of the present invention may be readily constructed and are entirely compatible with present conventional computers and computer interface devices, it is expected that they will be accepted in the industry as substitutes for conventional printers. The improved print quality, increased speed, and improved reliability of the inventive printers will make them desirable as substitutes and in new installations. For these and other reasons, it is expected that the utility and industrial applicability of the invention will be both significant in scope and long-lasting in duration.

What is claimed is:

1. An ink-jet pen for use in an ink-jet printer for depositing ink upon a print medium, including;

a printhead using more than one color of ink, said printhead being movably affixed to said printer such that it can be moved under computer control across said print medium, disbursing ink as required upon said medium, said printhead having a nozzle plate adapted for ejecting ink from said printhead onto said print medium, said nozzle plate including a plurality of nozzles arranged in a column, with the nozzles which are to supply like colors arranged into a plurality of groups of nozzles separated by inter-group spacings such that the nozzles for different color inks are physically separated by a greater distance than are nozzles for the same color ink, said inter-group spacings being an integer multiple of an index distance between adjacent nozzle centers for same color nozzles in one of said groups, said inter-group spacings less than a swath width established by one of said nozzle groups.

2. The ink-jet pen of claim 1, wherein the column into which the nozzles is arranged is a staggered column with alternate of the nozzles aligned and consecutive nozzle misaligned.

3. The ink-jet pen of claim 1 wherein said integer is two.

4. An ink jet pen for printing different colors of ink while simultaneously minimizing or eliminating color bleed, said pen including a plurality of nozzle groups, with each nozzle group dispensing a different color of ink and with adjacent nozzles in each group being separated by a certain distance, characterized in that adjacent groups of nozzles are always separated from each other by an inter-group spacing distance greater than said certain distance separating adjacent nozzles within each group, said inter-group spacing distance being an integer multiple, said integer greater than one, of an index distance between adjacent nozzle centers for same color nozzles in one of said groups, said inter-group spacing distance less than a swath width established by each said nozzle groups.

5. The ink jet pen defined in claim 4 wherein said nozzle groups are operative to dispense colors of cyan, yellow, magenta, and black.

6. The ink jet pen defined in claim 4 wherein said inter-group spacing distance between adjacent groups of nozzles is at least twice said certain distance separating adjacent nozzles within each group.

7. The ink jet pen defined in claim 6 wherein said nozzle groups are operative to dispense colors of cyan, yellow, magenta, and black.

8. The ink jet pen defined in claim 4 wherein said integer is two.

9. A multi-color ink-jet printer comprising:

a medium feed mechanism for moving a medium to be printed upon in a medium advancement direction;

a multi-color pen for printing on said medium, mounted on a pen carriage, said carriage for holding said pen such that said pen can be moved transversely by a pen traversing mechanism relative to said medium advancement direction, said pen including a printhead disbursing ink of multiple colors as required upon said medium;

said printhead having a single nozzle plate adapted for ejecting ink of multiple colors from said printhead onto said print medium, said nozzle plate including a plurality of nozzles, with the nozzles which are to supply like colors separated by inter-group spacings into a plurality of groups of nozzles such that the nozzles for different color inks are physically separated by a greater distance than are nozzles for the same color ink, said inter-group spacings being an integer multiple, said integer greater than one, of an index distance between adjacent nozzle centers for same color nozzles in one of said groups, said inter-group spacings less than a swath width established by each said nozzle groups;

said medium traversing means moving said printhead transversely across said medium such that each of said nozzle groups can print a swath across said medium, said swaths being separated by a distance substantially equal to said inter-group spacing;

said medium advancing means for advancing said medium by a swath advance distance after said printhead has printed a swath to position the medium for printing another swath, said medium advance distance substantially equal to said swath width; and a data offset from a nozzle of one color group to a corresponding nozzle of another, adjacent color group, said data offset equivalent to the number of nozzles of a color group swath plus said integer number.

10. The ink-jet printer defined in claim 9 wherein said nozzle groups are operative to dispense colors of cyan, yellow, magenta, and black.

11. The ink-jet printer defined in claim 9 wherein said integer is two.

* * * * *